US006283353B1

(12) United States Patent
Gilbert

(10) Patent No.: US 6,283,353 B1
(45) Date of Patent: Sep. 4, 2001

(54) PRESS ROLL DEVICE

(75) Inventor: Sylvain Gilbert, Saint-Prime (CA)

(73) Assignee: Equipements Gilbert Inc., Roberval (CA)

( * ) Notice: Subject to any disclaimer, the term of this patent is extended or adjusted under 35 U.S.C. 154(b) by 0 days.

(21) Appl. No.: 09/358,169

(22) Filed: Jul. 20, 1999

(51) Int. Cl.[7] ..... B65H 20/00

(52) U.S. Cl. ..... 226/190; 226/191; 226/188; 198/782; 198/788; 144/250.14; 144/250.16; 414/746.7

(58) Field of Search ..... 198/624, 688.1, 198/782, 788, 722; 144/246.1, 250.13, 250.14, 250.16; 226/186, 187, 190, 191, 188; 414/14, 746.7

(56) References Cited

U.S. PATENT DOCUMENTS

| | | | | |
|---|---|---|---|---|
| 387,417 | * | 8/1888 | Hoyt . | |
| 1,309,185 | * | 7/1919 | Coffman . | |
| 1,744,874 | * | 1/1930 | Edwards . | |
| 2,525,590 | * | 10/1950 | Collins . | |
| 3,737,022 | * | 6/1973 | DeNeefe et al. | 198/782 |
| 3,899,070 | * | 8/1975 | Lang | 198/782 |
| 3,990,568 | | 11/1976 | Wilson, Sr. | 198/624 |
| 4,067,370 | * | 1/1978 | Chang | 144/117.1 |
| 4,078,592 | * | 3/1978 | Standal | 198/782 X |
| 4,094,452 | * | 6/1978 | Makela | 226/34 |
| 4,441,536 | * | 4/1984 | Rautio | 144/39 |
| 4,510,981 | * | 4/1985 | Biller | 144/248.5 |
| 4,607,837 | * | 8/1986 | Pierce | 271/273 |
| 5,020,579 | * | 6/1991 | Strong . | |
| 5,676,238 | | 10/1997 | Saastamo | 198/502.2 |
| 5,680,888 | * | 10/1997 | St-Pierre et al. | 144/357 |
| 5,762,332 | * | 6/1998 | Haroutel et al. | 271/274 |
| 5,785,102 | * | 7/1998 | Hamel | 144/387 |
| 5,816,302 | * | 10/1998 | Newnes | 144/357 |

* cited by examiner

*Primary Examiner*—Donald P. Walsh
*Assistant Examiner*—Minh-Chau Pham
(74) *Attorney, Agent, or Firm*—Merchant & Gould P.C.

(57) ABSTRACT

A press roll device for applying pressure on a piece of wood moving along a path. The device has a frame mounted in proximity to the path of the piece of wood and a lower and an upper arm both pivotally connected to the frame. A roller is rotationally mounted on the end of the lower arm and a jack is resiliently connected to the corresponding end of the upper arm. A bag of compressed air is disposed between the ends of the lower and upper arm, resiliently separating the roller and the jack. In this manner, the bag of compressed air absorbs the vibration of the roller caused by unevenness in the piece of wood, at least partially.

10 Claims, 4 Drawing Sheets

PRESS ROLL DEVICE

FIELD OF THE INVENTION

The present invention relates to the field of machinery for the wood processing industry and particularly concerns a press roll device for applying pressure on a moving piece of wood.

BACKGROUND

Pieces of wood of all kinds moving through wood processing machinery need to be carried at a controlled speed and to follow a well defined path to be properly processed. There is known in the art to provide conveying systems with a motorised pressing roll mounted on a pivoting frame. The press roll both moves the wood along its path and applies a pressure thereon to keep it on track. The pivoting movement of the frame is resiliently controlled, for example, through a pneumatic or a hydraulic jack. In these systems a lot of strain is imposed on the jack since its movement has to compensate for the unevenness of the wood surface and keep the pressure thereon constant. The jack often fails to react quickly enough to the bigger bumps on the wood's surface, temporarily loosing its grip on the piece of wood which may then deviate from the right path.

OBJECTS AND SUMMARY OF THE INVENTION

It is therefore an object of the present invention to provide a press roll device that applies a more constant pressure on a piece of wood than conventional devices.

It is also an object of the present invention to provide such a device which has a better response time to unevenness in the piece of wood.

Yet another object of the invention is to provide such a device that puts less strain on the jack, thereby increasing its durability.

Accordingly, the present invention provides a press roll device for applying pressure on a piece of wood moving along a path, the device comprising:

- a frame mounted in proximity to the path of the piece of wood;
- a lower arm having a first end and a second end, the first end being pivotally connected to the frame;
- a roller for applying pressure on the piece of wood as said piece of wood moves along the path, the roller being rotationally mounted on the second end of the lower arm;
- an upper arm having a first end and a second end, the first end of the upper arm being pivotally connected to the frame, and the second end of the upper arm extending in proximity to and above the second end of the lower arm;
- resilient means disposed between the second ends of the lower and upper arms; and
- a jack resiliently connected to the second end of the upper arm, for applying a pressure on the piece of wood via the second end of the upper arm, the resilient means, the second end of the lower arm and the roller.

The advantages and features of the present invention will be better understood upon reading the following description of preferred embodiments thereof with reference to the appended drawings.

DESCRIPTION OF A PREFERRED EMBODIMENT OF THE INVENTION

With reference to FIGS. 1 to 4, there is shown a press roll device 10 in accordance with a preferred embodiment of the present invention. The device 10 is used for applying pressure on a piece of wood 12 moving along a path 14. In the illustrated embodiment, the action of the roller is the force used to push the piece of wood 12 along the path 14. Alternatively, the piece of wood 14 may be carried on a conveyor and the press roll device, motorized or not, is used only to keep it on the path 14.

Figure 1:
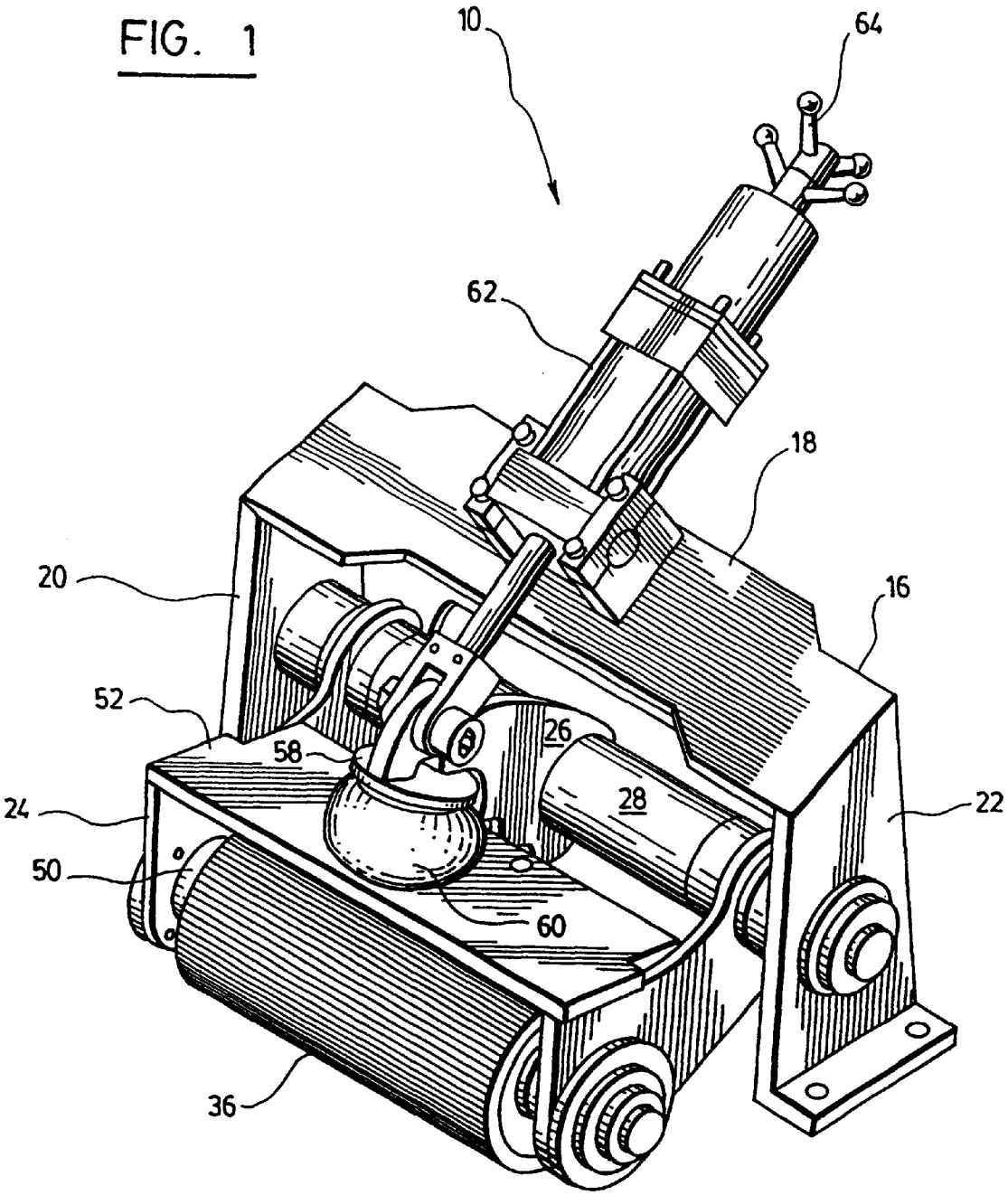
FIG. 1 is a front and side perspective view of a device in accordance with a preferred embodiment of the invention.
Figure 2:
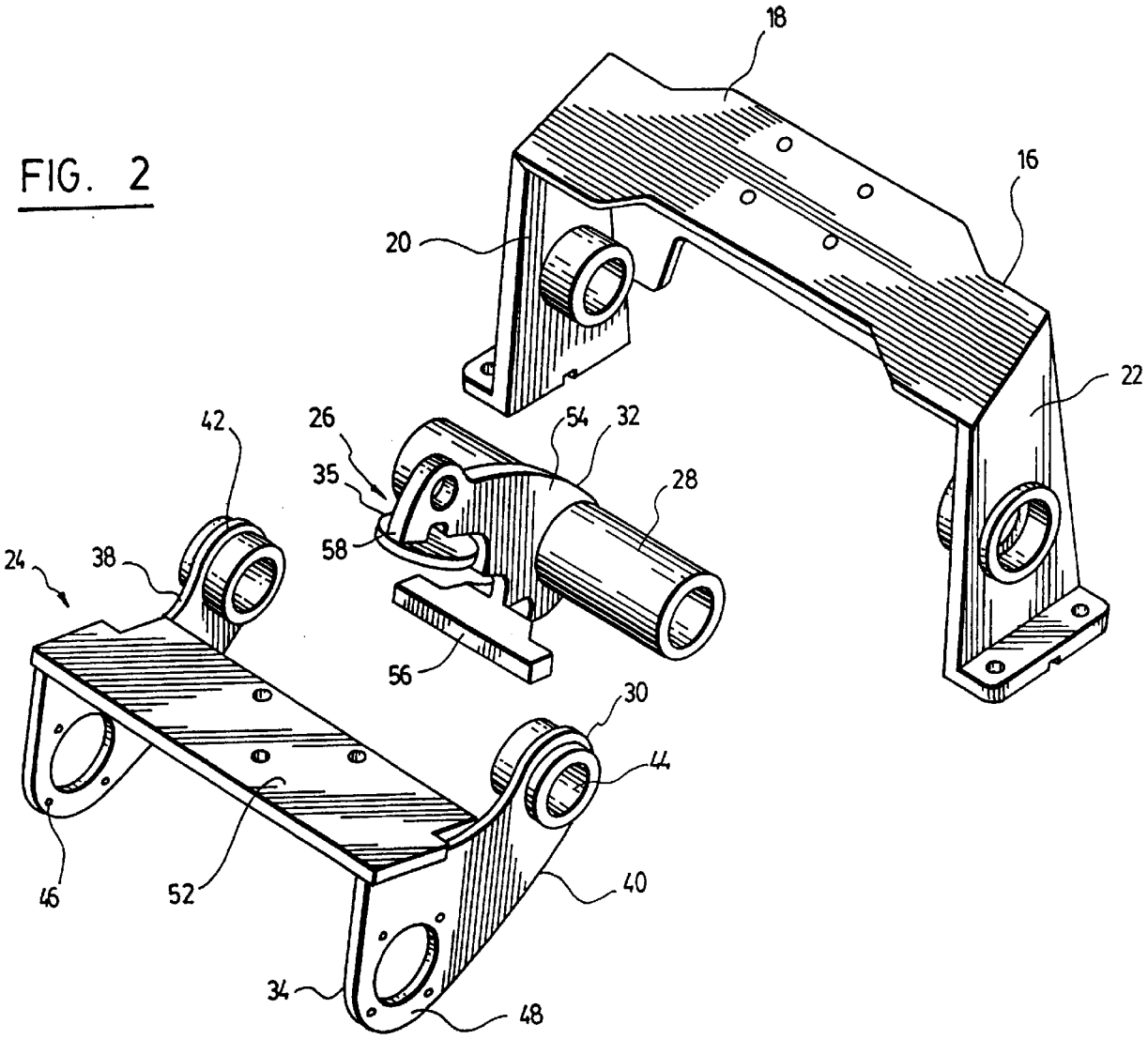
FIG. 2 is a partial exploded view of the device of FIG. 1.
Figure 3:
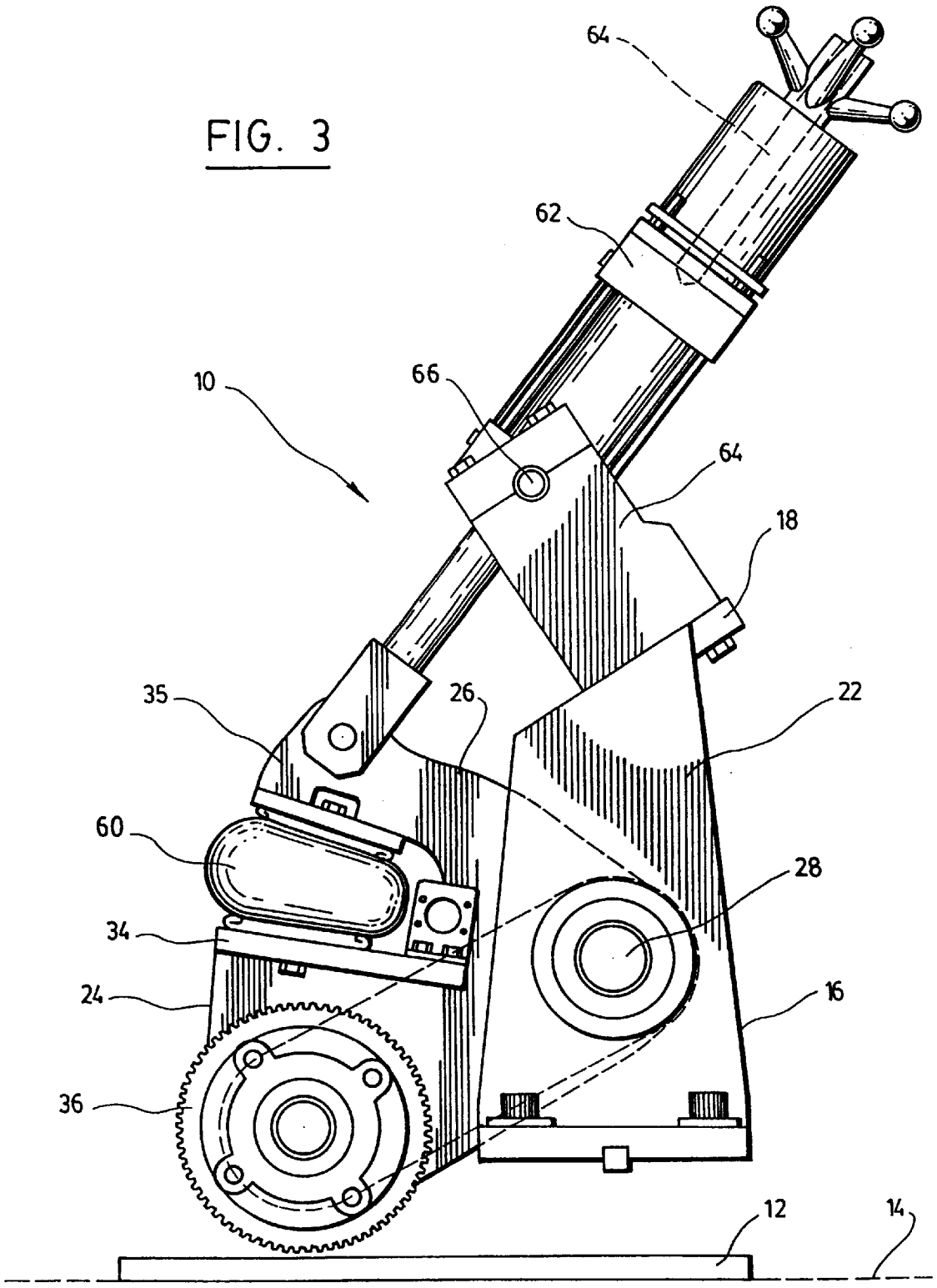
FIG. 3 is a side elevational view of the device of FIG. 1.

Referring more particularly to FIGS. 1 and 2, the device 10 has a frame 16 which is mounted in proximity to the path of the piece of wood. The frame 16 preferably has a top wall 18 and two generally parallel side walls 20 and 22. The device further includes a lower arm 24 and an upper arm 26, both pivotally connected to the frame 16. In the preferred embodiment, the frame includes a main shaft 28 extending between the side walls 22 and 24, each of the lower and upper arms 24 and 26 having a first end 30 and 32 connected thereto. The second end 34 of the lower arm 24 projects away from the frame 16, and is provided with a roller 36 rotationally mounted thereon. The second end 35 of the upper arm 26 also projects away from the frame 16, and extends in proximity to and above the second end 34 of the lower arm 24.

The lower arm 24 preferably has a pair of generally parallel side members 38 and 40, having their respective first ends 42 and 44 rotationally mounted around the main shaft 28. The second ends 46 and 48 and the side members 38 and 40 are projecting away from the frame 16. A roller shaft 50 is rotationally mounted between the second ends 46 and 48, the roller 36 extending therearound. A top member 52 extends over the second ends 46 and 48 of the side members 38 and 40.

The upper arm 26 is preferably a generally V-shaped member oriented sideways and having its central portion 54 rotationally mounted around the main shaft 28. The lower leg 56 of the V-shaped member projects under the top member 52 of the lower arm 24, and the upper leg 58 projects over the top member 52.

Referring again to FIGS. 1 to 4, the device 10 also includes resilient means, here embodied by a bag 60 filled with compressed air, disposed between the second ends 34 and 35 of the lower and upper arms 24 and 26. In the illustrated embodiment, the bag 60 is disposed on the top member 52 of the lower arm 24 and the upper leg 58 of the upper arm 26 contacts it from above. A jack 62 is resiliently connected to the second end 35 of the upper arm 26. The jack 62 may, for example, be a pneumatic jack or a hydraulic jack, and is preferably provided with a screw 64 for adjusting the pressure it applies on the components underneath. Preferably, the jack 62 is pivotally connected to the frame 16, as better seen in FIG. 3. For this purpose, a housing 64 is provided on the top wall 18 of the frame 16 and the jack 62 is mounted therein on additional shaft 66.

In this manner, the jack 62 applies a pressure on the piece of wood 12 via the second end 3 of the upper arm 26, the bag of compressed air 60, the second end 34 of the lower arm 24 and the roller 36. However, when the roller 36 encounters unevenness in the piece of wood 12, the reaction movement of the lower arm 24 is absorbed by the compressed air bag 60, keeping the strain on the jack 62 at a minimum. Advantageously, this system allows a better reaction time to unevenness in the wood and keeps the pressure on the piece of wood more constant than with conventional press rolls. The lifetime of the jack is also increased since it is not solicited by every small movement of the roller.

Figure 4:
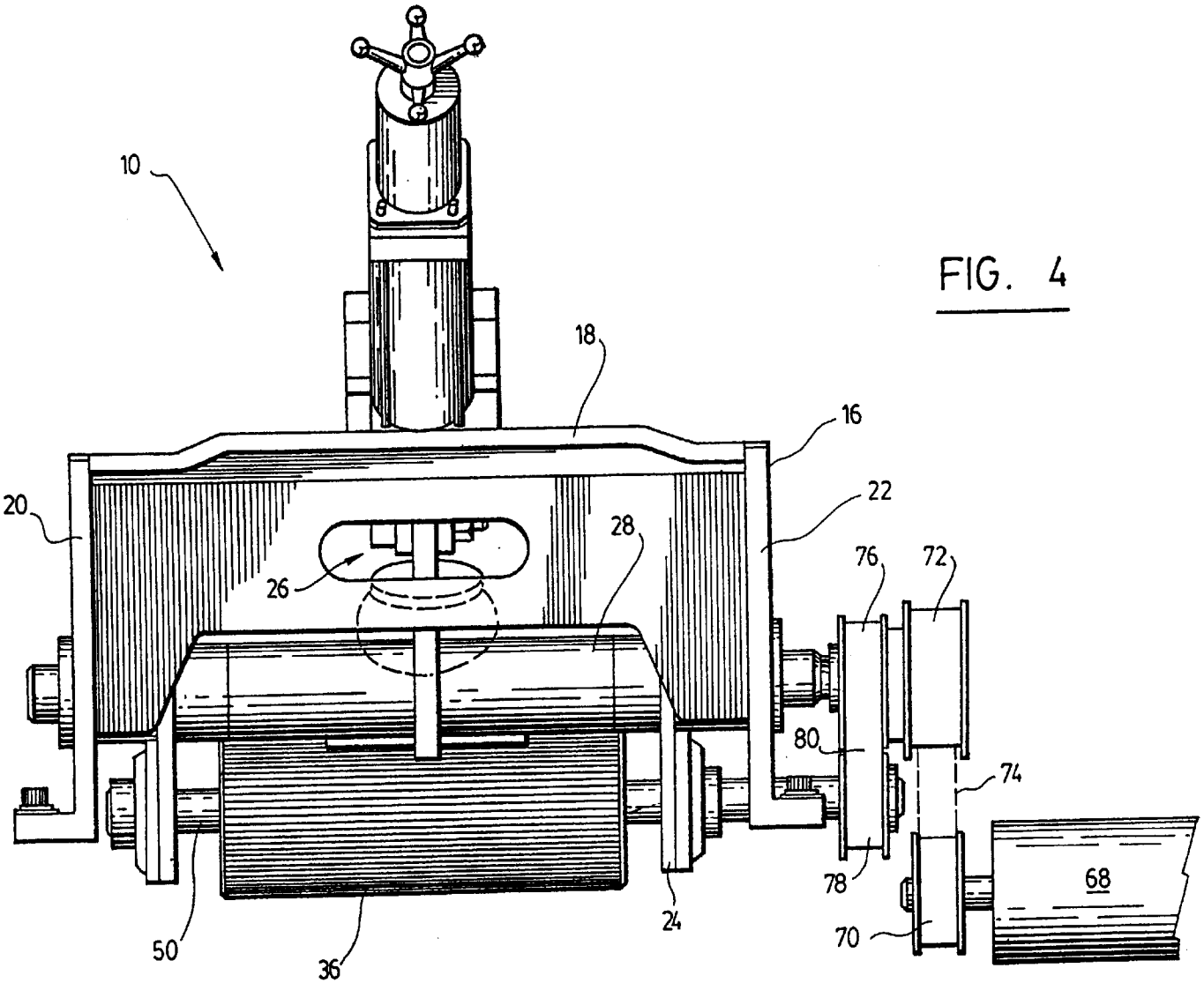
FIG. 4 is a front view of the device a FIG. 1.

Referring to FIG. 4, there is shown that the device 10 of the present embodiment is designed so that the roller 36 applies the moving force conveying the piece of wood 12 along the path 14. For this purpose, means to rotate the roller 36 are provided, which preferably include a motor 68 having a gear 70 connected to an outer gear 72 of the main shaft 28 via a first driving belt 74. The main shaft 28 also has an inner gear 76 which is connected to the roller gear 78 on the roller shaft 50 via a second driving belt 80. In this manner, both the main shaft 28 and the roller shaft 50 are rotated by the motor 68.

Of course, numerous modifications can be made to the preferred embodiments disclosed hereinabove without departing from the scope of the invention as defined in the appended claims.

What is claimed is:

1. A press roll device for applying pressure on a piece of wood moving along a path, the device comprising:

a frame mounted in proximity to the path of the piece of wood;

a lower arm having a first end and a second end, the first end being pivotally connected to the frame;

a roller for applying pressure on the piece of wood as said piece of wood moves along the path, the roller being rotationally mounted on the second end of the lower arm;

an upper arm having a first end and a second end, the first end of the upper arm being pivotally connected to the frame, and the second end of the upper arm extending in proximity to and above the second end of the lower arm;

a bag filled with compressed air disposed between the second ends of the lower and upper arms; and a jack connected to the second end of the upper arm, for applying a pressure on the piece of wood via the second end of the upper arm, the bag, the second end of the lower arm and the roller.

2. A device according to claim 1, wherein the jack is provided with a screw for adjusting the pressure applied on the piece of wood.

3. A device according to claim 1, wherein the jack is a pneumatic jack.

4. A device according to claim 1, wherein the jack is pivotally connected to the frame.

5. A device according to claim 1, further comprising a main shaft mounted on the frame, the first ends of the lower and upper arms being both mounted around said shaft.

6. A device according to claim 5, wherein the frame comprises a top wall and two generally parallel side walls, the main shaft extending between said side walls.

7. A device according to claim 6, wherein the lower arm comprises:

a pair of generally parallel side members, each side member having a first end rotationally mounted around the main shaft and a second end projecting away from the frame;

a roller shaft rotationally mounted between the second ends of the side members, the roller extending around said roller shaft; and a top member extending over the second ends of the side members, said top member contacting the bag.

8. A device according to claim 7, wherein the upper arm comprises a generally V-shaped member having a central portion rotationally mounted around the main shaft, a lower leg projecting under the top member of the lower arm and an upper leg projecting over said top member of the lower arm, the upper leg contacting the bag.

9. A device according to claim 7, further comprising rotating means for rotating the roller.

10. A device according to claim 9, wherein the rotating means comprise:

a motor;

a first driving belt connecting the main shaft to the motor for rotating said main shaft;

a second driving belt connecting the main shaft to the roller shaft for rotating said roller shaft, thereby rotating the roller.

* * * * *